United States Patent [19]

Guzowski

[11] Patent Number: 4,516,700

[45] Date of Patent: May 14, 1985

[54] HOT MELT ANTI-SURGE DISPENSING SYSTEM

[75] Inventor: Raymond J. Guzowski, New Hudson, Mich.

[73] Assignee: Pyles Division, Wixom, Mich.

[21] Appl. No.: 363,943

[22] Filed: Mar. 31, 1982

[51] Int. Cl.[3] ..... B67D 5/46

[52] U.S. Cl. ..... 222/330; 222/334; 222/383

[58] Field of Search ..... 222/334, 330, 331, 375, 222/373, 380, 383, 385, 146 HE

[56] References Cited

U.S. PATENT DOCUMENTS

| | | | |
|---|---|---|---|
| 2,578,102 | 12/1951 | Stephenson et al. | 222/334 X |
| 3,412,903 | 11/1968 | Van Riper, Jr. et al. | 222/146 |
| 3,976,229 | 8/1976 | Jackson | 222/146 |
| 4,028,473 | 6/1977 | Conti | 222/334 X |

*Primary Examiner*—Charles A. Marmor
*Attorney, Agent, or Firm*—Beaman & Beaman

[57] ABSTRACT

The invention pertains to a system for dispensing highly viscous materials, such as hot melt adhesives, wherein flow surges are eliminated. The material is pumped by an expansible chamber motor operated by compressed air and flow through a dispensing nozzle is controlled by a valve. Air pressure regulators provide a low pressure on the material when no dispensing is occurring, and a higher pressure is imposed upon the air motor during dispensing. Selectivity between air pressures is regulated by an electric switch simultaneously operated with the dispensing nozzle wherein the higher dispensing pressure is imposed on the pump motor only after the nozzle has been opened, thereby preventing material flow surges. If dispensing occurs through a plurality of nozzles communicating with a common pump additional air pressure regulators are provided to increase the pump flow proportional to the amount of material being dispensed to provide uniform dispensing characteristics from each of the dispensing nozzles.

7 Claims, 3 Drawing Figures

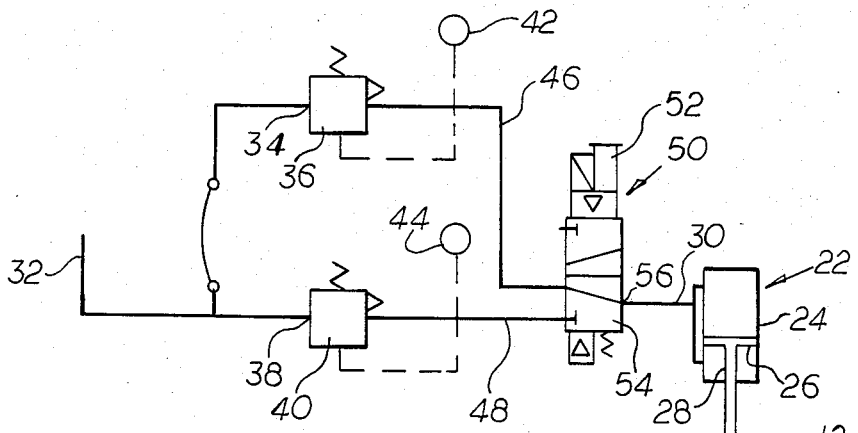
FIG. 1.
FIG. 2.
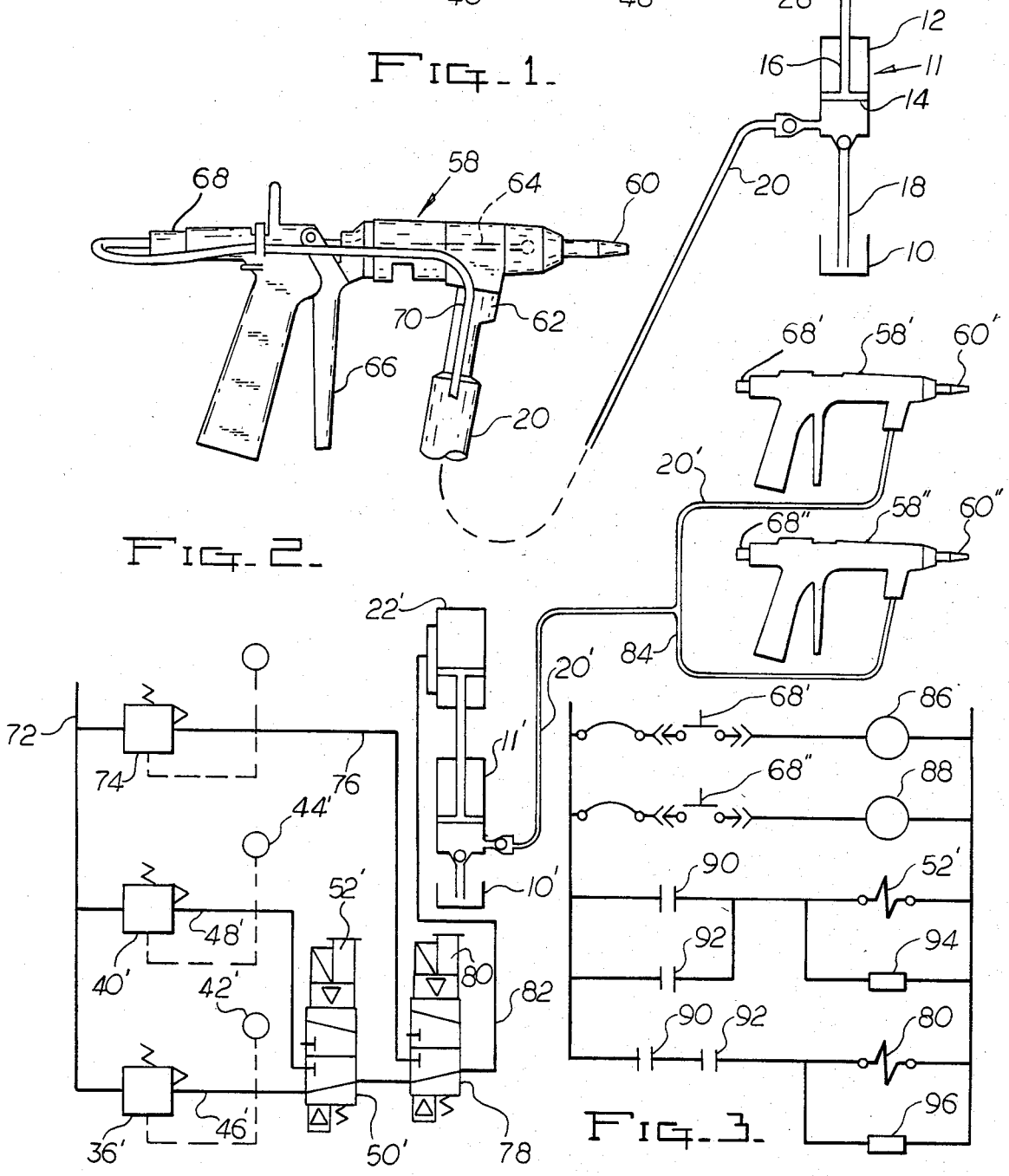
FIG. 3.

HOT MELT ANTI-SURGE DISPENSING SYSTEM

BACKGROUND OF THE INVENTION

Highly viscous materials, such as adhesives, sealants, and the like may be packaged within drums for storage and shipment, and while such materials are flowable at elevated temperatures, the materials are substantially solid at normal ambient temperatures and require reheating prior to usage. For instance, such thermoplastic adhesives are widely used for assembly purposes in the automobile and construction arts, and sealants of this type are often employed in the fabrication of multiple pane window units.

Dispensing apparatus for highly viscous hot melt materials have been developed by the assignee, and others, and normally include a head or platen which is received within the material drum for engagement with the surface of the material. The platen is heated causing the material adjacent thereto to melt and become flowable, and a pump mounted upon an elevating apparatus includes an inlet adjacent the platen wherein the melted material may be drawn into the pump and dispensed through a distribution system, such as a heated hose line and nozzle. The nozzle may be hand held and operated by a manual lever controlling a valve wherein opening of the valve permits dispensing.

Operation of the pump is usually through an expansible chamber motor operated by compressed air. Accordingly, the reciprocal movements of the air motor piston and piston rod are transmitted to a pump piston rod and piston causing the pump to draw melted material into its chamber during piston rod retraction, and forcing material from the pump chamber during extension of the air motor piston rod.

As such combination expansible chamber pump and motor units are powered by compressed air, and as the compressed air pressure within the air motor is at a relatively high dispensing pressure when the dispensing nozzle valve is closed, a surge of material is expelled from the nozzle when its valve is initially opened. It is necessary to maintain a relatively high pressure within the air motor during dispensing to produce the desired rate of flow, but the air pressures existing within the air motor when the dispensing valve is closed are such as to usually produce a surge of material ejected from the nozzle when the nozzle is opened causing excess material to be dispensed which may result in defects and unsightly material deposits, and cause an uneven material distribution which may result in leakage or other serious problems.

When the dispensing valve is closed the air motor and pump will "stall out" and become immobilized due to the lack of material flow and the components will be under the relatively high pressure required for dispensing. This condition causes fatigue on the motor, pump and valve components, as well as produces the initial material surge, and is objectionable as it shortens the life of the equipment.

Apparatus such as that described above is generally represented in U.S. Pat. Nos. 3,412,903 and 3,976,229, and in such apparatus surging and high pressure stalling will occur.

Further, in prior art dispensing equipment, if multiple dispensing heads are being supplied from a single pump the pressure upon the air motor must be increased in order to maintain the desired quantity of flow through each head, and in such a system the presence of such high air motor pressures results in even more serious surge problems, especially if the dispensing nozzles are not simultaneously operated.

It is an object of the invention to provide a dispensing system for viscous materials utilizing a compressed air expansible motor operated pump wherein material flow surges are eliminated during start and stop operations.

A further object of the invention is to provide a dispensing system for viscous materials pumped by a compressed air operated motor wherein material flow surges are eliminated during the initial stage of material flow and wherein a substantially uniform flow of material is maintained during dispensing.

Another object of the invention is to provide a compressed air controlled dispensing system for viscous materials wherein variable air pressures control dispensing dependent upon the condition of a material flow control valve.

Another object of the invention is to provide a compressed air powered dispensing system for viscous materials wherein a plurality of dispensing nozzles or heads are provided from a single pump, and wherein variable air pressures are imposed upon the pump drive motor dependent upon the condition of the dispensing valves whereby a minimum air pressure is utilized when no dispensing is occurring, an intermediate air pressure is supplied to the pump motor when dispensing through a single nozzle is occurring, and a maximum air pressure is supplied to the pump air motor when a plurality of nozzles are dispensing to provide a uniform and equal material flow through each nozzle.

Yet another object of the invention is to provide a compressed air controlled dispensing system for viscous material utilizing a plurality of dispensing nozzles supplied from a common compressed air powered pump wherein flow surges from the nozzles are prevented by controlling the pressure within the pump dependent upon the operation of the dispensing nozzles, and wherein operation of the dispensing nozzles may not be simultaneous, but may be intermittent or sequential.

In the practice of the invention an expansible chamber pump utilizing a piston mounted upon a piston rod is operated by an expansible chamber air motor employing a piston rod common or connected to the pump rod mounted upon a piston within the air motor. The air motor is connected to a compressed air source and valved to reciprocate causing the pump piston to reciprocate for alternately drawing material into the pump chamber and expelling the same therefrom. The pump communicates with a source of viscous material, such as a hot melt adhesive or sealant, drawing the material into the pump chamber as the pump chamber increases in volume, and the material is forced from the pump chamber into a heated hose line as the pump chamber volume is reduced.

The pumped material is dispensed through a valved nozzle or head, usually heated, wherein the material is discharged when the valve is opened, and dispensing ceases upon the valve closing. If the dispensing nozzle is in the form of a hand held gun a manually operated trigger lever is normally employed to control the position of the valve.

A compressed air source communicates with an air pressure control system including at least two air pressure regulators communicating with a valve controlling flow to the air motor. One of the regulators produces a low pressure output, while the output of the other regulator is significantly higher. Both regulators communicate with a solenoid operated three way valve communicating with the pump air motor which determines which of the regulators are supplying compressed air thereto.

An electric switch is associated with the valve at the dispensing nozzle wherein opening of the valve to dispense pumped material closes the switch, while closing of the dispensing valve opens the switch contacts. As the shifting of the solenoid operated valve is controlled by the electric switch at the dispensing nozzle it will be appreciated that selectivity of high and low air pressures to the air motor is dependent upon the position of the nozzle valve.

In order to eliminate material flow surges, closing of the dispensing valve shifts the solenoid valve to the position which establishes communication between the low air pressure regulator and the air motor. Thus, a low "stall" pressure is imposed upon the air motor and pump when dispensing is not occurring. Opening of the dispensing valve will close the electric switch shifting the solenoid valve to the position permitting higher pressure compressed air to be introduced into the pump air motor to provide the necessary pumping force and flow of material through the nozzle to achieve the desired dispensing characteristics. Accordingly, it will be appreciated that higher pressure compressed air is only introduced into the pump air motor during dispensing, and a lower air pressure is imposed on the pump air motor when dispensing is not occurring. Thus, when the dispensing valve is initially opened the reduced pressure upon the pumped material will not cause a surge of material to be expelled from the dispensing nozzle and a much more uniform flow from the nozzle is achieved during the stop and start sequences of dispensing.

In those instances wherein a plurality of dispensing nozzles are supplied from a common pump, for instance, it is not uncommon for two dispensing nozzles to be connected to a single pump, it is also possible to utilize the concepts of the invention. In multiple dispensing nozzle or head systems wherein the dispensing nozzles normally operate intermittently and randomly, rather than simultaneously, additional compressed air regulators are used to provide higher air pressures at the pump air motor dependent upon the amount of material being pumped at a given time.

For instance, a third air regulator is included in the air control system having a compressed air output pressure higher than that of the higher air pressure regulator used in a dispensing system employing only a single nozzle. In such instance, the solenoid controlled valve includes additional control passages, or may constitute a second solenoid control valve which selectively communicates with the three air regulators, and determines whether a low stall pressure, intermediate pressure, or high air pressure is transmitted to the pump air motor.

Each of the two dispensing nozzles includes a valve and electric switch associated therewith, and the electric switches are connected in parallel with respect to the solenoid operated valve means wherein opening of either dispensing nozzle will shift the solenoid operated valve means from the low stall pressure flow path to the pump air motor to the higher intermediate air pressure required to permit the desired dispensing through a single nozzle. The dispensing nozzle electric switches are also connected in series to the solenoid valve means wherein the highest air pressure is supplied to the pump air motor if both dispensing nozzles are open, and in such instance the air supplied to the pump and motor is sufficient to substantially double the flow of dispensed material to achieve the desired flow rates at both nozzles.

Accordingly, the air pressure supplied to the pump air motor will be controlled in accord with the pumping pressures required to achieve optimum dispensing characteristics of the viscous material, and yet, surging of the material will be eliminated. A further advantage of the invention over conventional dispensing systems results from the extended life of the components due to a reduction in fatigue pressures because of the elimination of high static stall-out pressures.

BRIEF DESCRIPTION OF THE DRAWINGS

The aforementioned objects and advantages of the invention will be appreciated from the following description and accompanying drawings wherein:

FIG. 1 is a schematic view of the air control circuit, pump, air motor and single manual dispensing nozzle, in accord with the invention, FIG. 2 is a circuit diagram of an air control circuit as used with a multiple dispensing nozzle system, and FIG. 3 is a diagram of the electrical circuit used with the air control circuit of FIG. 2 for a plurality of dispensing nozzles.

DESCRIPTION OF THE PREFERRED EMBODIMENTS

In FIG. 1 the pump and associated air motor are schematically illustrated, and the arrangement of these components is more fully appreciated with reference to the assignee's U.S. Pat. No. 3,976,229. In FIG. 1 the reservoir for the viscous material is shown at 10, and this reservoir may be formed within the heated head of a hot melt dispensing system, or the pump may communicate with the melted viscous material located directly below a heated head within a material drum or container as in U.S. Pat. No. 3,412,903. The pump 11 includes a cylinder 12 in which a piston 14 is reciprocally displaceable by means of a piston rod 16. The pump includes an inlet conduit 18 communicating with the reservoir and cylinder 12 through a check valve, and the material drawn into the cylinder during the suction stroke is expelled from the cylinder through a check valve into hose 20, which is usually electrically heated.

The reciprocal operation of the pump piston 14 is by an expansible chamber air motor 22 which includes a cylinder 24 having piston 26 reciprocal therein as mounted upon piston rod 28. In FIG. 1 the piston rods 16 and 28 are shown of a unitary construction, and it will be appreciated that in actual practice various adjustable components, or the like, interconnect the pump 11 and air motor 22 and the air motor drives the pump piston producing the cyclic reciprocation thereof.

Compressed air is supplied to the air motor 22 via supply conduit 30, and the compressed air is alternately supplied to opposite sides of the piston 26 by conventional valve control means, not shown, to alternately pressurize opposite sides of the piston to produce the desired reciprocal action.

The compressed air circuit supplying the air motor 22 includes a conduit 32 attached to a source of compressed air, not shown. The supply of compressed air is connected to the inlet 34 of air pressure regulator 36, and the inlet 38 of air pressure regulator 40. Each of the regulators includes a pressure gauge 42 and 44, respectively, indicating the pressure of the air available at the outlet conduit 46 of the regulator 36, and at the outlet conduit 48 of the regulator 40.

As shown in FIG. 1, a three-way control valve 50 receives compressed air from the conduits 46 and 48, and the valve 50 is of the single solenoid pilot, spring offset type, wherein energization of the solenoid 52 will reciprocate the valve block 54. The conduit 30 supplying the air motor 22 is connected to the valve outlet port 56.

With the valve 50 in the position shown in FIG. 1, it will be appreciated that the flow path through the valve establishes communication between regulator 36, conduit 30, and the air motor 22. As the regulator 36 is the low or stall pressure regulator, with the valve 50 in the position of FIG. 1 low pressure air is being supplied to the air motor 22. Shifting of the valve 50 to its second position by energization of the solenoid 52 establishes communication between regulator 40 and the air motor 22, and disconnects regulator 36 from the motor wherein only the higher air pressure supplied by regulator 40 is pressurizing the air motor.

The dispensing means shown in FIG. 1 is in the form of a hand held gun 58, which includes a dispensing nozzle 60. The gun is supplied with flowable viscous material through the hose 20, connected to pump 11, and usually, the gun will include heating elements at 62 to maintain the flowability of the material being handled. The dispensing apparatus includes a valve 64 which is controlled by finger operated lever 66 wherein opening of the valve 64 permits material to flow from the nozzle 60, and closing of the valve terminates dispensing.

Additionally, the gun 58 includes an electric switch 68 connected to eonductor 70, and the electric switch is mechanically operated by the lever 66 through any conventional mechanical arrangement, not shown, whereby operation of the lever to open the valve 64 to produce dispensing will simultaneously close the contacts of the switch 68, and conversely, closing of the valve 64 opens the switch contacts. The switch 68 is connected to solenoid 52 to control the operation thereof.

In operation, the normal condition exists when the dispensing valve 64 is closed, the solenoid 52 is deenergized and the valve 50 will be in the position shown in FIG. 1 wherein the low air pressure regulator 36 will be communicating with the motor 22. Because the valve 64 is closed the pump 11 and motor 22 will be "stalled" and the pressure within the pump, hose 20 and dispensing gun will be minimal. When it is desired to dispense material, the operator squeezes the lever 66 opening valve 64, and this opening of the valve also closes the contacts of the switch 68. As the switch 68 controls energization of the solenoid 52 the valve 50 will immediately be shifted to its second position establishing communication between regulator 40 and the air motor 22. As the higher pressure output of regulator 40 has been predetermined to impose a force on the air motor capable of operating the pump 11 at that rate which produces the desired dispensing flow rate at nozzle 60 this higher motor and pump pressure only occurs after the valve 64 has been opened, and thus no surge ejecting excess material occurs when the valve 64 is initially shifted to the open condition.

As soon as the valve 64 is closed to terminate dispensing, the contacts of switch 68 will be opened causing the valve 50 to shift to the position of FIG. 1 and once again imposing only the lower pressure air from regulator 36 upon the air motor 22. When the valve 64 is closed, a positive air pressure exists within the air motor, although this pressure is substantially less than that produced by regulator 40, and this lower air pressure is sufficient to supply the viscous material through the hose 20 and insure availability of the material when dispensing is to resume. However, the operation of the system will insure that the valve 64 will be opened prior to the pump 11 being powered by the higher air pressure.

FIG. 3 illustrates an air control circuit which may be used to control a pump supplying two dispensing guns and nozzles and components similar to those previously described are identified by primed reference numerals. In this circuit three air regulators each receive their input of compressed air through a supply conduit 72. Regulator 36' is the lowest pressure regulator having an output at conduit 46', and this output pressure constitutes the "at rest" and stall pressure which exists when no dispensing is taking place. Pressure regulator 40' produces an output pressure within conduit 48' equal to that of regulator 40 whereby the proper air pressure is supplied capable of producing the necessary pump output for dispensing through a single nozzle. Air pressure regulator 74 provides a compressed air pressure within conduit 76 higher than the output of regulator 40', and this pressure is sufficient to operate the air motor and pump, at a capacity capable of supplying two nozzles during dispensing.

The regulators 36' and 40' are connected to the solenoid operated valve 50' which is of the single solenoid pilot type using a spring return. The valve 78 is a similar solenoid operated valve operated by solenoid 80. The valve and regulator interconnections will be appreciated from FIG. 2, and the output of compressed air from the circuit enters conduit 82 which is associated with an air motor 22', which is identical to the air motor 22 of FIG. 1. A pump 11' similar to pump 11 is powered by the air motor 22' and the output of the pump 10 is associated with two hoses 20' and 84 which are connected to dispenser guns 58' and 58'', such as the gun 58 shown in FIG. 1, the dispensing guns each being identical.

The valves 50' and 78 are controlled by the electrical circuit shown in FIG. 3. The electric switch 68' associated with the dispensing gun 58' operates a relay 86, while the electric switch 68'' associated with the other dispensing gun 58'' operates a relay 88. The solenoid 52' of valve 50' is connected in parallel with contacts 90 of relay 86 and contacts 92 of relay 88, and a resistor 94 is also connected in parallel across the solenoid. The solenoid 80 of valve 78 is connected in series with the contacts 90 of relay 86 and the contacts 92 of relay 88, and is also connected in parallel with the resistor 96.

In the operation of a dual dispensing system as shown in FIGS. 2 and 3, in the nondispensing mode the switches 68' and 68'' will be open, and the valves 50' and 78 will be in the condition shown in FIG. 2. Thus, the low stall air pressure from regulator 36' will be imposed upon the pump air motor 22', and upon the initial opening of either dispensing nozzle 60' or 60'' the pressure imposed upon the pumped material will not be great enough to cause a surge through the dispensing nozzle. Upon an operator dispensing through one nozzle the switch 68', or switch 68'', will be closed causing a closing of either contacts 90 or 92 to energize solenoid 52' and shift valve 50' to the position connecting the output conduit 48′ of regulator 40′ with the motor supply conduit 82. In this mode, dispensing will occur as in the aforedescribed embodiment wherein a sufficient pressure is applied to the pump air motor, and pump, to permit dispensing at the desired rate through a single nozzle.

If, while dispensing through one nozzle is occurring, the other switch 68′ or 68″ is closed due to an opening of the associated nozzle, the other contacts 90 or 92 will be closed energizing the solenoid 80 of valve 78 to shift the valve. Under such circumstances the highest air pressure is supplied through the regulator 74 to the pump air motor through conduits 76 and 82, and the pump will be operated at a pressure and velocity capable of providing the desired flow characteristics through both gun dispensing nozzles.

When dispensing through either nozzle is terminated the solenoid 80 is deenergized causing the valve 78 to shift to the position of FIG. 2, again causing regulator 40′ to provide the desired pump air motor pressure, and upon dispensing ceasing through either nozzle the regulator 36′ then becomes the sole source of compressed air for the air motor and pump.

It will therefore be appreciated that the practice of the invention will prevent surging in dispensing systems for viscous materials upon the dispensing nozzle being initially opened, and uniform dispensing characteristics are achieved in multiple dispensing head systems wherein the output of the pump is varied in accordance with the demand for dispensed material. In the described embodiments electrical switches have been illustrated as used to control the air control valves, but it is to be understood that other surging control systems, such as air operated systems, could be employed to accomplish similar functions and purposes, and it is understood that other modifications to the inventive concepts may be apparent to those skilled in the art without departing from the spirit and scope of the invention.

I claim:

1. An anti-surge dispensing system for viscous materials wherein the system includes a pump for the material operated by an expansible chamber air motor powered by a compressed air source and a valved dispensing nozzle in communication with the pump, the improvement comprising air pressure control means interposed between the air motor and compressed air source controlling the air pressure supplied to the air motor in accordance with the condition of the valve of the dispensing nozzle, said air pressure control means including a first air pressure regulator having a low air pressure output, a second air pressure regulator having an air pressure output higher than that of said first regulator, electrically operated valve means communicating with said regulators and the air motor having a first position supplying low pressure air to the air motor and a second position supplying higher pressure air to the air motor, and an electric switch simultaneouly operated with the valve of the dispensing nozzle controlling the position of said valve means whereby a low air pressure is supplied to the air motor when the dispensing nozzle valve is closed and a higher air pressure is supplied to the air motor when the dispensing nozzle valve is opened.

2. In an anti-surge dispensing system as in claim 1, a hand held dispensing gun, the valved dispensing nozzle being defined on said dispensing gun, said gun including a manual valve operating trigger, and said electric switch being operated by said trigger.

3. In an anti-surge dispensing system as in claim 1, wherein the dispensing system includes a second valved dispensing nozzle in communication with the pump, said air pressure control means including a third air pressure regulator having a high pressure output of a higher pressure than that of said second regulator, said third regulator communicating with said electrically operated valve means, and a second electric switch simultaneously operated with the valve of the second dispensing nozzle electrically connected to said valve means whereby operation of both electric switches during simultaneous dispensing through both nozzles operates said electrically operated valve means to supply high pressure compressed air from said regulator to the air motor.

4. An anti-surge dispensing system for viscous materials comprising, in combination, a viscous material expansible chamber pump having a material inlet and a pumped material outlet, an expansible chamber air motor operatively connected to said pump and having a compressed air inlet, a source of compressed air, air pressure control means interposed between said source of compressed air and said air motor, said control means including a first air pressure regulator having a low air pressure output, a second air pressure regulator having an air pressure output higher than that of said first regulator, electrically operated valve means communicating with said regulators and communicating with said air motor inlet controlling the supply of compressed air to said air motor having a first position supplying low pressure air to said air motor and a second position supplying high pressure air to said air motor, a first valved dispensing nozzle communicating with said pump outlet selectively dispensing pumped material, and a first electric switch simultaneously operated with the valve of said first dispensing nozzle controlling the position of said valve means whereby a low air pressure is supplied to said air motor when the valve of said dispensing nozzle is closed and a higher air pressure is supplied to said air motor when the dispensing nozzle valve is open.

5. In an anti-surge dispensing system as in claim 4, said valved dispensing nozzle comprising a hand held gun having a manually operated trigger, said electric switch and the nozzle valve being operated by said trigger.

6. In an anti-surge dispensing system as in claim 4, said air pressure control means including a third air pressure regulator having an air pressure outlet higher than that of said second regulator, said third regulator output communicating with said electrically operated valve means, a second valved dispensing nozzle communicating with said pump outlet selectively dispensing pumped material, a second electric switch simultaneously operated with the valve of said second dispensing nozzle controlling the position of said valve means, said valve means including a third position supplying high pressure air from said third regulator to said air motor, said switches being connected in parallel to said valve means to position said valve means to said second position if either switch is operated during dispensing from a single nozzle, and said switches being connected in series to said valve means to position said valve means to said third position when both switches are operated during simultaneous dispensing from said first and second nozzles.

7. In an anti-surge dispensing system as in claim 6, said electrically operated valve means comprises first and second solenoid operated valves, said first valve being connected to said first and second regulators, said second valve being connected to said third regulator, and said switches being connected in parallel to said first valve and being connected in series to said second valve.

* * * * *